US007165998B2

(12) United States Patent
Lee et al.

(10) Patent No.: US 7,165,998 B2
(45) Date of Patent: Jan. 23, 2007

(54) STRUCTURE OF USB COMPATIBLE APPLICATION APPARATUS

(75) Inventors: Chung-Liang Lee, Taipei (TW); Chanson Lin, Jhubei (TW); Ken Tsai, Taipei (TW)

(73) Assignee: Innodisk Corporation, Taipei (TW)

( * ) Notice: Subject to any disclaimer, the term of this patent is extended or adjusted under 35 U.S.C. 154(b) by 0 days.

(21) Appl. No.: 11/101,489

(22) Filed: Apr. 8, 2005

(65) Prior Publication Data

US 2006/0094301 A1 May 4, 2006

Related U.S. Application Data

(60) Provisional application No. 60/623,221, filed on Nov. 1, 2004.

(51) Int. Cl.
*H01R 24/00* (2006.01)

(52) U.S. Cl. ..... 439/660

(58) Field of Classification Search ..... 439/660, 439/76.1

See application file for complete search history.

(56) References Cited

U.S. PATENT DOCUMENTS 6,778,401 B1 * 8/2004 Yu et al. ..... 361/752
6,804,749 B1 * 10/2004 Chien et al. ..... 711/115
6,854,984 B1 * 2/2005 Lee et al. ..... 439/79
6,948,983 B1 * 9/2005 Peng ..... 439/660
6,999,322 B1 * 2/2006 Lin ..... 361/752
7,004,794 B1 * 2/2006 Wang et al. ..... 439/660
2005/0042930 A1 * 2/2005 Harkabi et al. ..... 439/660
2005/0277332 A1 * 12/2005 Chen ..... 439/607
2006/0002096 A1 * 1/2006 Wang et al. ..... 361/752
2006/0024997 A1 * 2/2006 Teicher ..... 439/217

* cited by examiner

*Primary Examiner*—Briggitte Hammond
*Assistant Examiner*—Larisa Tsukerman
(74) *Attorney, Agent, or Firm*—Rosenberg, Klein & Lee

(57) ABSTRACT

An improved structure of USB compatible application apparatus is mainly provided a PCB circuit board to be a USB compatible application module of a connector. A top surface of the PCB carrying board is used to carry a plurality of connecting terminators. A board bottom sandwich is naturally formed between a bottom surface of the PCB carrying board and an covering shell of the connector. At least one electrical element are fixed inside of the board bottom thereby selectively reducing a length of a USB compatible application module or increasing working efficiency of the USB compatible application module. Further, at least one board top data transmission lines are set on part of the top surface of the PCB carrying board without setting the first connecting terminators thereby further raising working efficiency of the USB compatible application apparatus.

10 Claims, 7 Drawing Sheets

STRUCTURE OF USB COMPATIBLE APPLICATION APPARATUS

REFERENCE TO RELATED APPLICATIONS

This Patent Application is based on Provisional Patent Application Ser. No. 60/623,221, filed 1 Nov. 2004.

FIELD OF THE INVENTION

The present invention is related to an improved structure of a USB compatible application apparatus, and more particularly to an improved structure using a PCB circuit board to be a carrying board inside of a connector. It can not only reduce a length of the USB compatible application apparatus but also efficiently raise working efficiency of the USB compatible application apparatus.

BACKGROUND

Accordingly, since quipped with advantages of convenience, extension, and high transmission speed in use for users, universal serial bus (USB) transmission interface is widely applied in various computer peripheral devices, information appliance products (IA) or 3C consuming electrical products. It is a transmission interface tool, which human beings cannot live in work and family without.

A prior art USB apparatus structure, as shown in FIG. 1 and FIG. 2, is a USB application apparatus 10 having a USB connector 11 (Series A Plug), such as storage memory devices, e.g. flash drive, MP3 walkman, or digital voice recorder. A front end thereof is mainly a USB connector 11. An exterior structure of the USB connector 11 is a metal covering shell 113 round covering a carrying board 111. A bottom surface of the carrying board 111 is clung to an interior lower surface of the covering shell 113. A top surface of the carrying board 111 is naturally formed a connecting sandwich 115 capable of connecting to another USB connecting bracket (Series A Receptacle) (71, as shown in FIG. 8) with an interior upper surface of the covering shell 113.

Further, a plurality of connecting terminators 13 can be fixed at the top surface of the carrying board 111 which are respectively a VCC power source line 131, a GND power source line 137, a D+ data transmission line 133, and a D− data transmission line 135 wherein the D+ data transmission line 133 and the D− data transmission line 135 can be proceeded in transmitting data, and the VCC power source line 131 and the GND power source line 137 can accept working current supplied by a USB host or a power supply.

Further, a USB application module 15 with a length L1 is connected to a back end of the USB connector 11. The USB application module 15 uses a covering shell 155 to clad a circuit board 157. A memory element 153 for storing data and a control circuit 151 are fixed on a surface of the circuit board 157. Two ends of the control circuit 151 can connect to the memory element 153 and the connecting terminators 13, respectively. Furthermore, a protection cap 17 is further set. The protection cap 17 covers the USB connector 11 by a way of covering to achieve an object of protecting the USB connector 11.

In the previous mentioned prior art USB application apparatus 10, the carrying board 111 is a filled resin material. The only function is carrying and fixing the USB connecting terminators 13. However, quite a bit volume of the USB connector 11 is occupied. And therefore, it is hard to reduce the volume or length of the USB application apparatus 10.

Whether manufacturing cost or portable convenience of the USB application apparatus 10, quite a bit waste and inconvenience are caused.

Further, in the prior art USB connector 11, the top surface of the carrying board 111 only has only a VCC power source line 131, a GND power source line 137, a D+ transmission line 133, and a D− transmission line 135, the data transmission lines are obviously not enough. Therefore, the working efficiency thereof is also limited. It cannot totally meet the requirements of the efficiency of the information products nowadays.

Further, the protection cap 17 of the prior art USB application apparatus 10 is fixed at the exterior surface of the USB connector 11 by a way of covering. This fixing way can achieve an object of protecting the USB connector 11, but it also increase the whole volume of the USB application apparatus 10.

Further, The prior art USB connector 11 and the USB covering shell 155 are made of different materials. Therefore, in the manufacturing process, both are manufactured individually then adhered together. This way, the inconvenience in manufacturing is increased, and dangling will be existed between the USB connector 11 and the USB covering shell 155 if the adhesive effect is not good in an adhering process. For a long time, corruption of the connecting line inside of the USB application apparatus 10 will be caused.

SUMMARY OF THE INVENTION

Accordingly, how to design an improved structure of a new USB compatible application apparatus respect to previous mentioned shortcomings of the USB compatible connector and USB compatible application apparatus which can not only reduce a length of the USB compatible application apparatus but also increase the working efficiency of the USB compatible application apparatus is the key point of the present invention.

It is a primary object of the present invention to provide an improved structure of a USB compatible application apparatus mainly using a PCB carrying board to replace prior art carrying board and using a board bottom sandwich naturally formed between the bottom surface of the PCB carrying board and the covering shell of the connector to fix at least one IC circuits or at least one electrical elements therein thereby achieving an object of reducing the length of the USB compatible application apparatus or increasing working efficiency of the USB compatible application apparatus.

It is a secondary object of the present invention to provide an improved structure of the USB compatible application apparatus capable of adding other data transmission lines in single connector thereby not only raising transmission bandwidth and transmission speed of signals of the USB compatible application apparatus but only increasing the working efficiency thereof.

It is another object of the present invention to provide an improved structure of the USB compatible application apparatus whose protection plug can directly plug into the connecting sandwich preserved at the top surface of the carrying board and the covering shell. It not only can achieve an object of protecting the connector but also efficiently reduce the whole volume of the USB compatible application apparatus.

It is another object of the present invention to provide an improved structure of the USB compatible application apparatus wherein the covering shell of the connector and the covering shell of the USB module can be chosen the same material and formed by a way of formed integral thereby reducing the manufacturing flow of the USB compatible application apparatus and the manufacturing cost.

It is another object of the present invention to provide an improved structure of the USB compatible application apparatus wherein the thickness of the carrying board inside of the connector can be reduced without changing the space of the connecting sandwich to achieve an object of reducing the thickness of the connector.

Therefore, to achieve the previous mentioned object, the present invention provides an improved structure of the USB compatible application apparatus mainly uses a connector to connect a USB compatible application module wherein the connector uses an enclosure to clad a PCB carrying board made of a PCB circuit board such that the top surface and the covering shell of the PCB carrying board can naturally form a connecting sandwich therebetween. Further, a plurality of first connecting terminators capable of electrically connecting to the USB compatible application module fixed at the top surface of the PCB carrying board. The connecting sandwich and a corresponding USB connecting bracket can be plugged into each other, and the first connecting terminators will electrically connect to the second connecting terminators fixed in the USB connecting bracket when the USB connecting bracket plugs into the connecting sandwich. Further, a board bottom sandwich is further naturally formed between the bottom surface and the covering shell of the PCB carrying board in the connector, and at least one electrical element is fixed on the bottom surface of the PCB carrying board.

Further, the present invention also provides an improved structure of the USB compatible application apparatus mainly uses a connector to connect a USB compatible application module wherein the connector uses an enclosure to clad a PCB carrying board. The top surface and covering shell of the carrying board can naturally form a connecting sandwich therebetween thereby reducing the thickness of the carrying board such that the thickness of the connector will be less than 0.4 cm and can be plugged with a standard Series A USB with each other.

DETAILED DESCRIPTION

The structural features and the effects to be achieved may further be understood and appreciated by reference to the presently preferred embodiments together with the detailed description.

Figure 1:
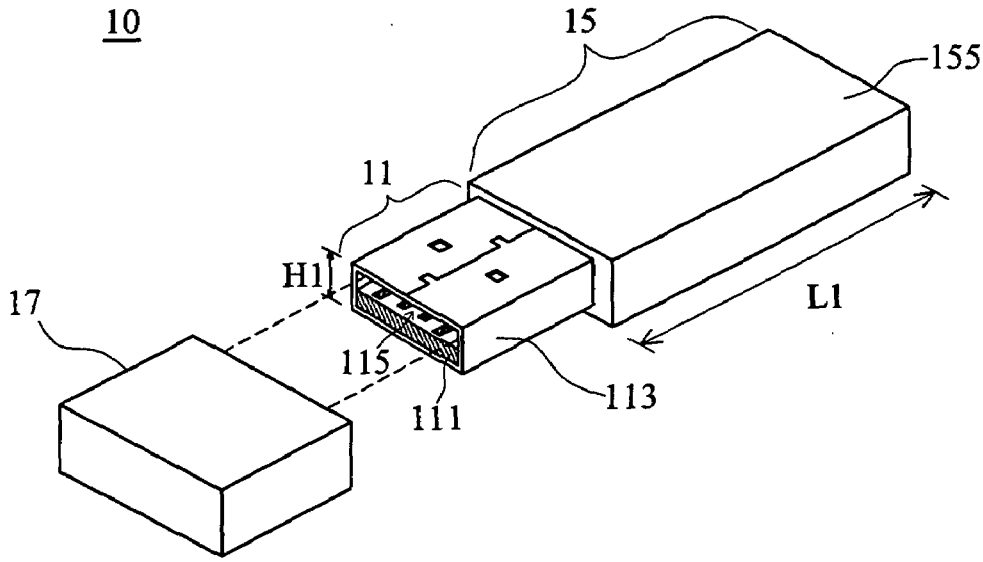
FIG. 1 (PRIOR ART)
FIG. 1 is a stereoscopic diagram of a prior art USB application apparatus.
Figure 2:
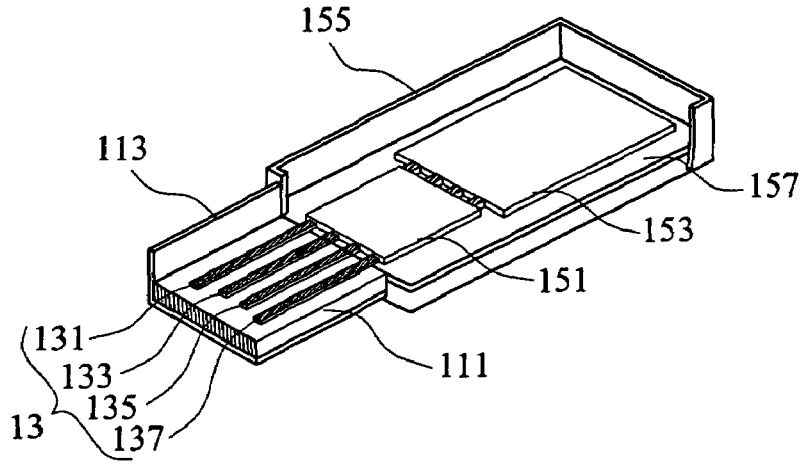
FIG. 2 (PRIOR ART)
FIG. 2 is a structural profile diagram of the prior art USB application apparatus.
Figure 3:
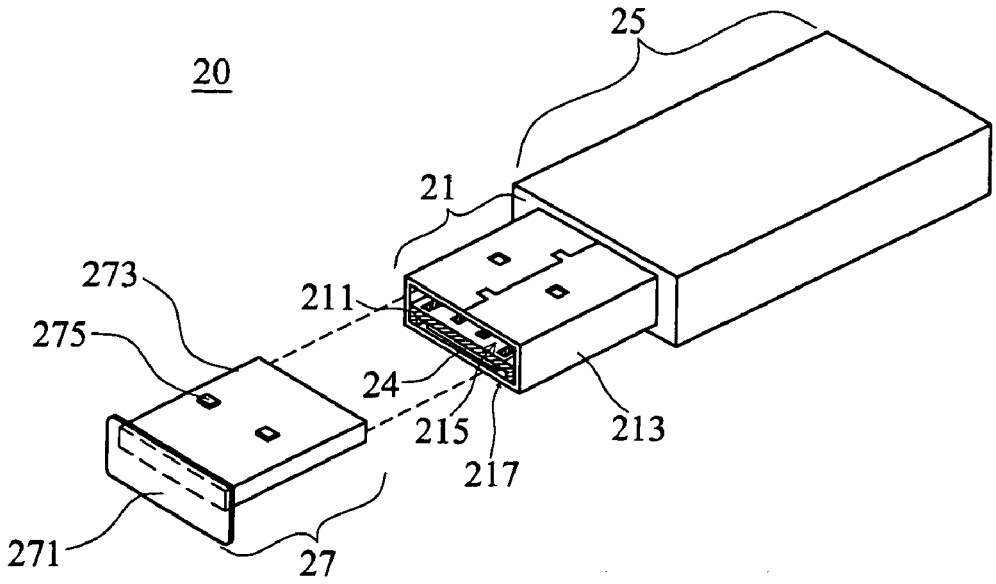
FIG. 3 is a stereoscopic diagram of a preferred embodiment of the USB compatible application apparatus of the present invention.
Figure 3A:
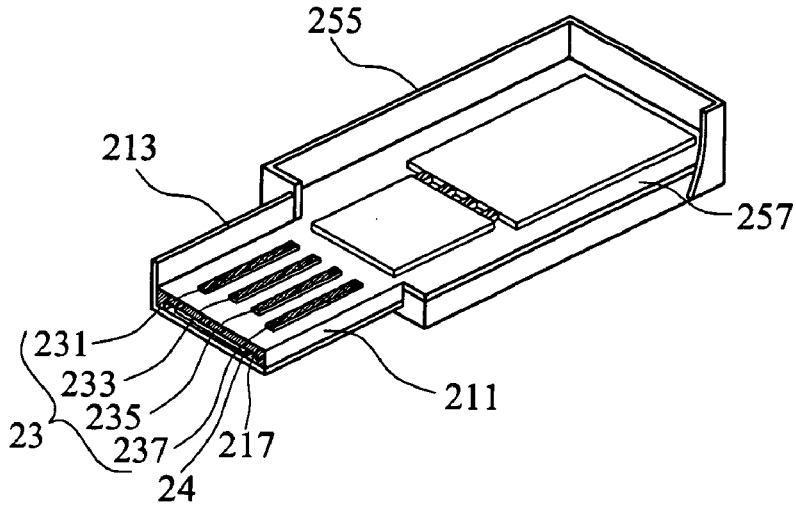
FIG. 3A is a partial structural profile diagram of the embodiment as shown in FIG. 3 of the present invention.
Figure 8:
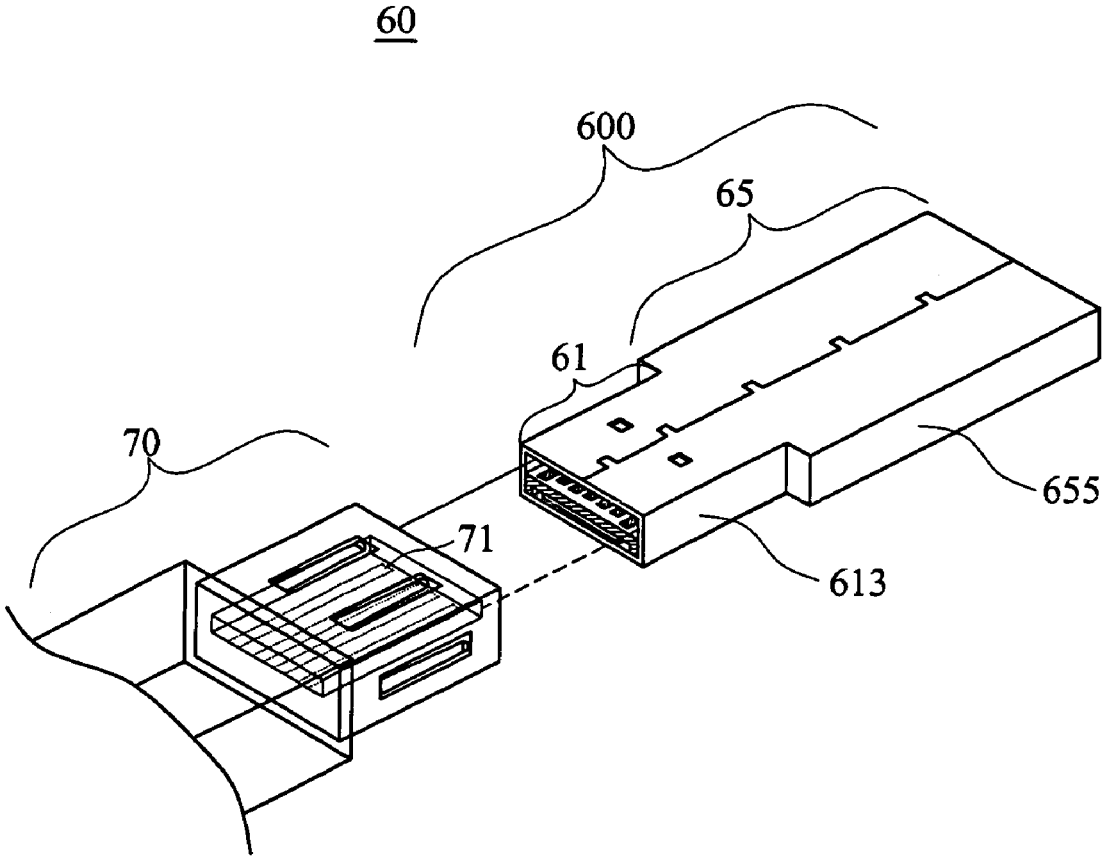
FIG. 8 is a stereoscopic diagram of another embodiment of the USB compatible application apparatus of the present invention.

First, referring to FIG. 3 and FIG. 3A, respectively a stereoscopic diagram and partial structural profile diagram of a preferred embodiment of the USB compatible application apparatus of the present invention. As shown, the USB compatible application apparatus 20 of the present invention, such as one of a memory, flash drive, blue tooth, digital camera, MP3 walkman, control circuit, GPS, digital voice recorder, television module, and wireless network card module, has a connector (Series A Plug) 21 set at the front end thereof. The back end of the connector 21 connects to a USB compatible application module 25. Therein, the connector 21 uses a covering shell 213 covering a PCB carrying board 211 made of a PCB circuit board. A connecting sandwich 215 is naturally formed between a top surface and the covering shell 213 of the PCB carrying board 211. The connecting sandwich 215 and another connecting bracket (Series A receptacle) (70, as shown in FIG. 8) can plug into each other. The top surface of the PCB carrying board 211 in the connecting sandwich 215 can carry a plurality of connecting terminators 23 capable of electrically connecting to the electrical application module 25. When the connecting sandwich 215 and a corresponding USB connecting bracket (70, as shown in FIG. 8) plug into each other, the first connecting terminators 23 can electrically connect to the second connecting terminator (71, as shown in FIG. 8) in the USB connecting bracket.

Further, a board bottom sandwich 217 can also be naturally formed between a bottom surface and the covering shell 213 of the PCB carrying board 211. At least one electrical element 24 or a board bottom data transmission line can be set in the board bottom sandwich 217. The electrical elements 24 can be designed as another set of working elements, which can increase working efficiency, and the board bottom data transmission line can increase the function of transmission thereby increasing the working efficiency of the USB compatible application apparatus 20. Furthermore, the covering shell 213 of the connector 21 can be selectively made of a non-metal material, e.g. plastic, plasticity steel, or polymer and formed integral with a module covering shell 255 of the electrical application module 25. The PCB carrying board 211 in the connector 21 can also be formed integral with an application circuit board in the electrical application module 25.

Further, a protection plug 27 is set to coordinate with a size of the connector 21. The structure of the protection plug 27 uses an exposed end 271 to traverse to connect a plugging end 273 wherein a cross-section area of the plugging end 273 is smaller than a cross-section area of the connecting sandwich 215 thereby directly plugging the plugging end 273 of the protection plug 27 into the interior of the connecting sandwich 215. It can not only protect the connector 21 but also reduce the volume of the USB compatible application apparatus 20. Further, at least one fixing apparatuses 275 can be added to the exterior surface of the plugging end 273. The fixing apparatuses 275 can be designed as a locking latch such that the protection plug 27 can be further fixed on the connector 21. When the protection plug 27 is to be taken out, just press the fixing apparatus 275 and then pull out the protection plug 27. Further, the cross-section area of the exposed end 271 of the protection plug 27 can be designed as bigger than the cross-section area of the covering shell 213 of the connector 21 to be benefit for accessing the protection plug 27.

Figure 4:
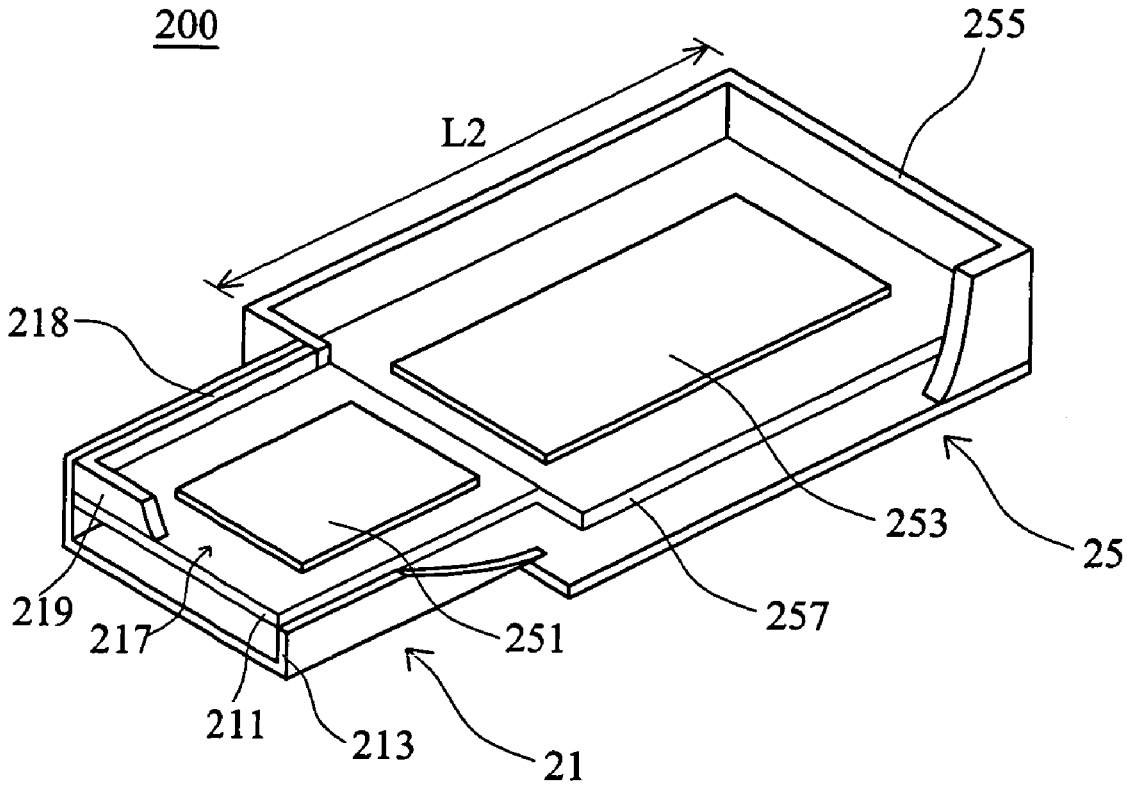
FIG. 4 is a look up structural cross-section diagram of another embodiment of the USB compatible application apparatus of the present invention.

Moreover, referring FIG. 4, a look up structural cross-section diagram of another embodiment of the present invention. As shown, a control circuit 251 is set at the bottom surface of the PCB carrying board 211 in the USB compatible application apparatus 200. Since the thickness of the prior art carrying board (111) is approximately 1.9 mm to 2 mm, the thickness of the normal circuit board 211 is approximately 0.3 mm to 0.7 mm, and the thickness of the control circuit 251 is approximately 1.2 mm to 0.65 mm, after overlapping fixing the circuit board 211 and the control circuit 251, the total thickness is also smaller than the thickness of the carrying board (111) of the prior art USB application apparatus (10). Therefore, partial electrical element or control circuit 251 which was set in the USB application module 25 is set inside of the board bottom sandwich 217 naturally formed between the board bottom and the covering shell 213 of the PCB carrying board 211, and the control circuit 251 is used to be a connecting interface of the first connecting terminators (23) and the memory device 253 in the USB compatible application module 25 thereby reducing the length L2 of the USB compatible application module 25 of the present invention to be shorter than the length L1 of the prior art USB application module (15). This way, the length of the USB compatible application apparatus (20) can be reduced by a wide margin.

Further, the previous mentioned USB compatible application module 25 uses a module covering shell 255 to clad an application circuit board 257 wherein the application circuit board 257 can be formed integral with the PCB carrying board 211 inside of the connector 21. This way, the steps of individually manufacturing two different elements and then adhering together in the prior art technology can be dispensed. The time spending in manufacturing process can be efficiently shortened, and the manufacturing cost can be reduced. Further, if the PCB carrying board 211 is formed integral with the application circuit board 257, the strength of the whole structure can be increased, and the stability of the line connections between elements can be raised thereby increasing the endurance of the USB compatible application apparatus 200.

Further, at least one supportive device 218 can be added into the board bottom sandwich 217 formed between the bottom surface and the covering shell 213 of the PCB carrying board 211 in the previous mentioned connector 21. The supportive devices 218 are capable of fixing the size of the board bottom sandwich 217 and preventing the board bottom sandwich 217 from transforming by the force. Further, the conjoining face between the board bottom sandwich 217 and the external can have a front-end protection layer 219. The setting of the front end protection layer 219 can be used to protect the electrical elements (24) or control circuit 251 inside of the board bottom sandwich 217, meanwhile efficiently strengthen the structure of the board bottom sandwich 217.

Figure 5:
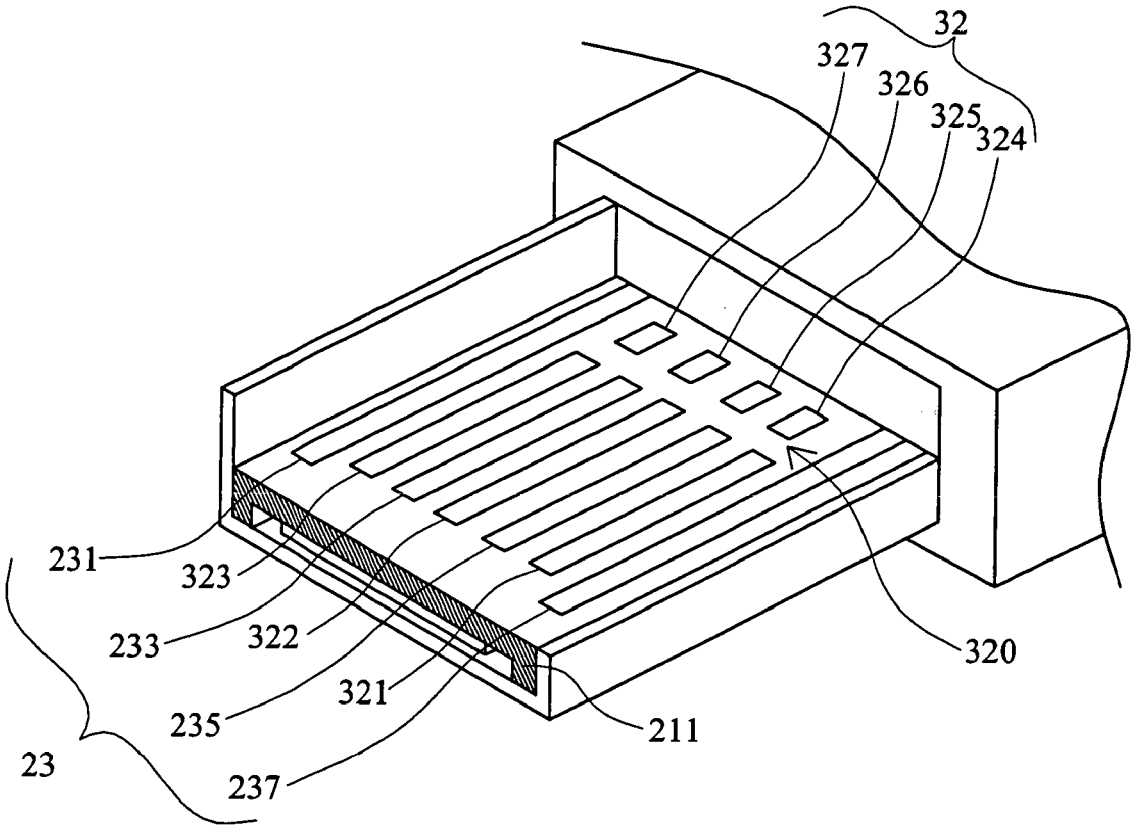
FIG. 5 is a stereoscopic diagram of another embodiment of the USB compatible application apparatus of the present invention.

Continuously, in another embodiment of the present invention, as shown in FIG. 5, a plurality of first connecting terminators 23 are set at the top surface of the PCB carrying board 211. The first connecting terminators 23 can comprise a VCC power source line 231, a GND power source line 237, a first data transmission line 233, and a second data transmission line 235. Therein, the first data transmission line 233 and the second data transmission line 235 can be designed as a corresponding D+/D− differential pair transmission lines to be benefit to increase the ability of the USB structure preventing noises, just as normal prior art USB structures. Further, a third data transmission line 322, a fourth data transmission line 323, and a fifth data transmission line 321 are also added at other partial positions of the top surface of the PCB carrying board 211. In another embodiment, a bottom data transmission line 32 can be further added on the bottom gap 320 of the back end of each data transmission line 233, 235, 321, 322, and 323 on the PCB carrying board 211. The bottom data transmission line 32 can comprise a sixth data transmission line 324, seventh data transmission line 325, eighth data transmission line 326, or ninth data transmission line 327, etc., which can be combined to a third bus signal transmission line (clock+8-bit data bus) of a signal 0 (clock), signal 1~signal 3, signal 5~signal 8 together with the first data transmission line 233, second data transmission line 235, third data transmission line 322, fourth data transmission line 323, and fifth data transmission line 321 thereby increasing the working items and working efficiency of the USB compatible application apparatus 20.

Of course, in another embodiment of the present invention, the first data transmission line 233 and the second data transmission line 235 can be designed as a non-D+/D− differential pair specification of transmission lines to be benefit for transmitting data.

Figure 6:
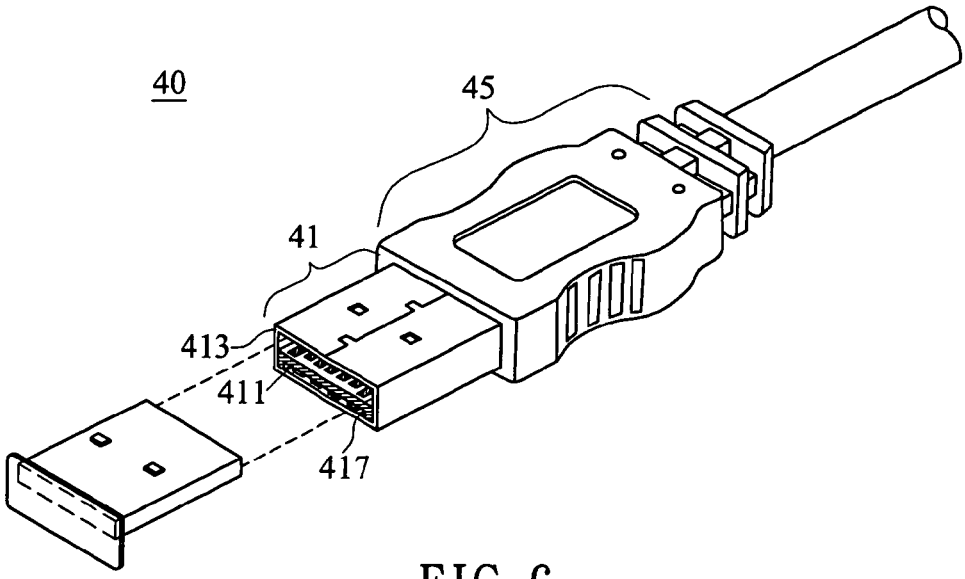
FIG. 6 is a stereoscopic diagram of another embodiment of the USB compatible application apparatus of the present invention.
Figure 6A:
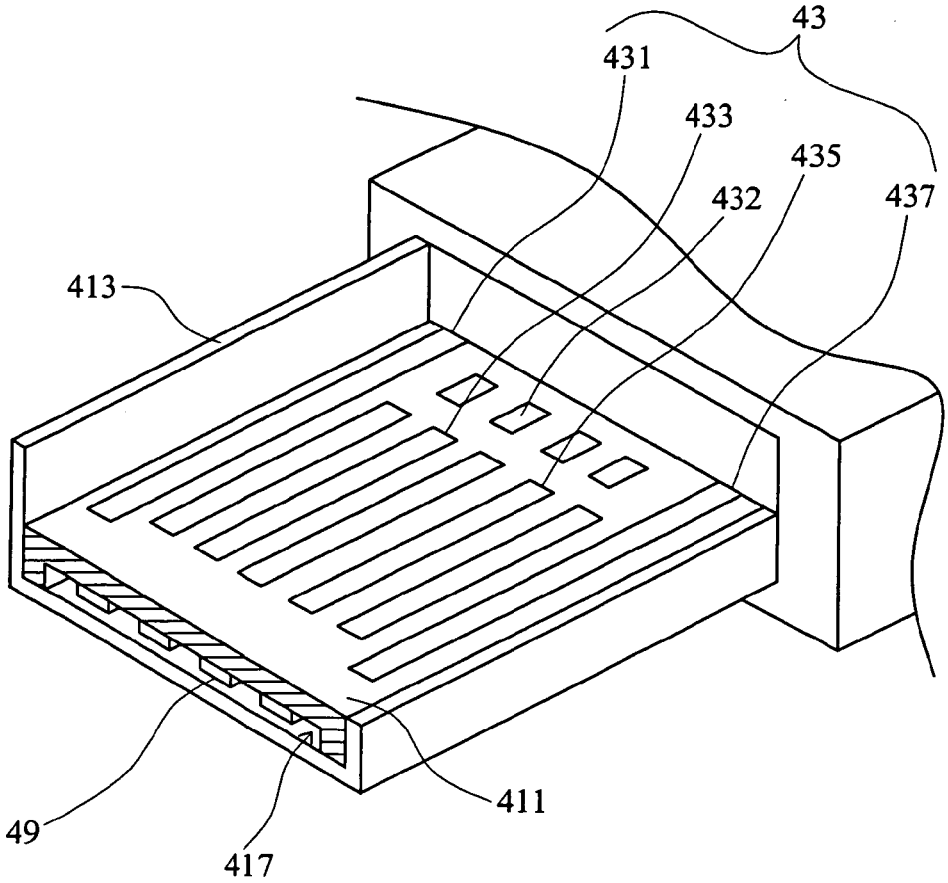
FIG. 6A is a partial structural profile diagram of the embodiment as shown in FIG. 6 of the present invention.

Furthermore, referring FIG. 6 and FIG. 6A, respectively a stereoscopic diagram and a partial structural profile diagram of another embodiment of the USB compatible application apparatus of the present invention. As shown, the USB compatible application apparatus with the USB transmission interface of the present invention comprises a connector 41. A USB compatible application module 45 is connected at the back end of the connector 41. In the USB compatible application apparatus 40 shown in the embodiment, it is shown a USB connecting line. The connector 41 uses a covering shell 413 to clad a PCB carrying board 411. A plurality of first connecting terminators 43 can be set at the top surface of the PCB carrying board 411. The first connecting terminators 43 can comprise a VCC power source line 431, a GND power source line 437, a first data transmission line 433, and a second data transmission line 435. At least one bottom data transmission lines 432 are added at the top surface of the PCB carrying board 411 without setting the first connecting terminators 43.

Further, a board bottom sandwich 417 can be naturally formed between the bottom surface and the covering shell 413 of the PCB carrying board 411. An electrical element or another set of board bottom data transmission lines 49 can be accommodated therein. The board bottom data transmission lines 49 can transmit a second set of signals in a situation of setting corresponding transmission lines at the connecting bracket (70, as shown in FIG. 8). This way, the transmission speed or working efficiency of the USB connecting lines can be efficiently raised. When the connecting bracket (70, as shown in FIG. 8) does not have corresponding transmission lines, the USB connector 40 can also use the first data transmission line 433 and a second data transmission line 435 to proceed prior art data transmission.

Further, in the embodiment, the PCB carrying board 411 in the connector 41 can also be selectively made of a material without the characteristic of the circuit board. This way, the choices of the material of the PCB carrying board 411 will be more diversify.

Figure 7:
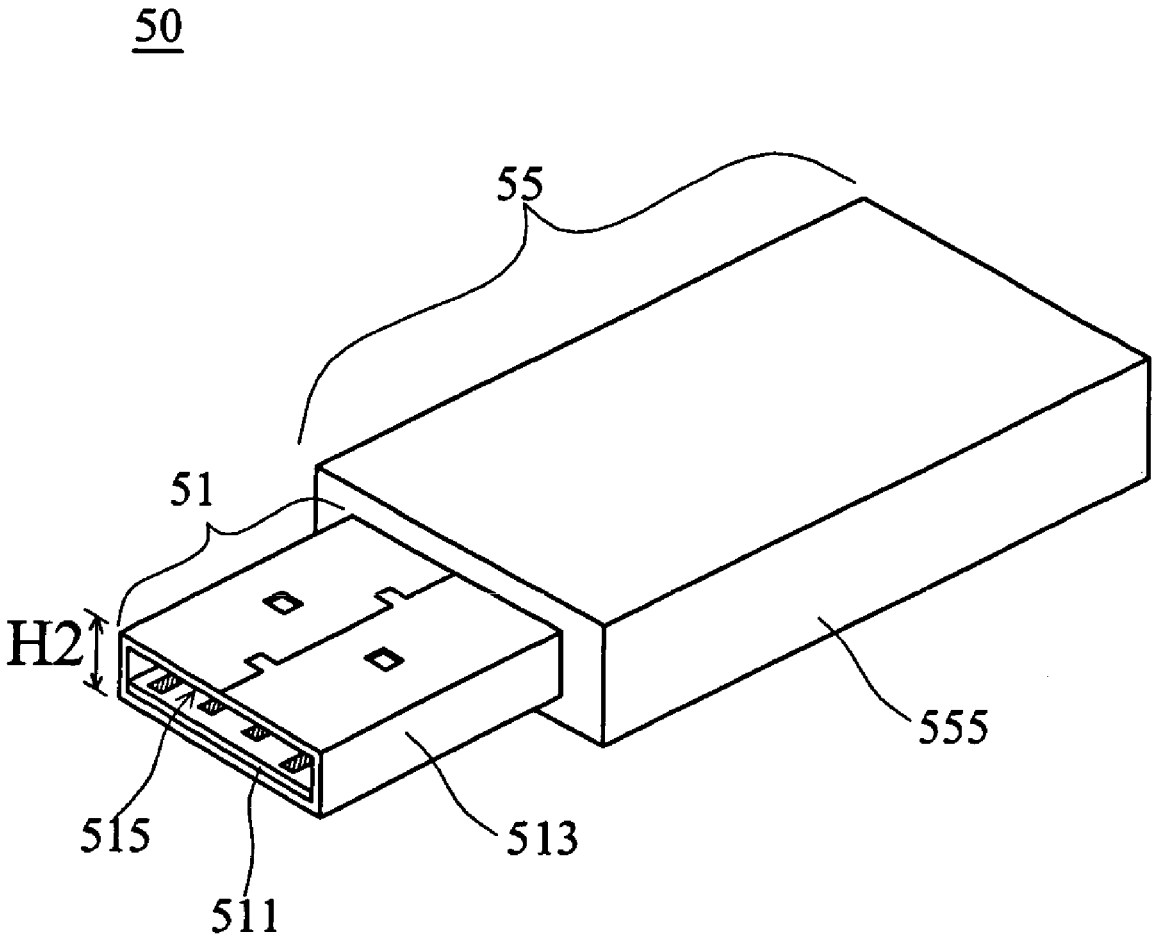
FIG. 7 is a stereoscopic diagram of another embodiment of the USB compatible application apparatus of the present invention.

Further, referring to FIG. 7, a stereoscopic diagram of another embodiment of the USB compatible application apparatus of the present invention. As shown, the present invention uses a connector 51 to connect an electrical application module 55 wherein the connector 51 uses an covering shell 513 to clad a carrying board 511 and reduces the thickness of the carrying board 511 such that the thickness H2 of the connector 51 is smaller than the thickness H1 of the prior art connector (11). In this embodiment, the thickness H2 of the connector 51 can be less than 0.4 cm. For example, the thickness of the carrying board 511 is approximately 0.3 mm to 1 mm, and the thickness of the connecting sandwich 515 is approximately 1.5 mm to 2.5 mm, so the total thickness of overlapping both will be 1.8 mm to 3.5 mm. If using a covering shell 513 to clad the carrying board 511 and the connecting sandwich 515, the preferable thickness of the connector 51 will be between 0.25 cm to 0.4 cm.

Moreover, the connecting sandwich 515 naturally formed between the top surface of the carrying board 511 and the covering shell 513 has the same space as the prior art connecting sandwich (115). This way, the connector 51 and the prior art USB connecting bracket (70, as shown in FIG. 8) can be plugged into each other and achieve the object of transmitting data. Further, if the thickness of the USB compatible application module 55 coordinates with the thickness H2 of the connector 51 and reduces, the thickness of the USB compatible application apparatus 50 can be efficiently reduced such that the USB compatible application apparatus 50 can be as a card type application apparatus.

Finally, referring to FIG. 8, a stereoscopic diagram of another embodiment of the USB compatible application apparatus of the present invention. As shown, the covering shell 613 of the connector 61 of the USB compatible application apparatus 60 with USB transmission interface is formed integral with the module covering shell 655 of the USB compatible application module 65 connecting at the back end of the connector 61 to become a USB covering shell 600. The material of the USB covering shell 600 can be chosen as a non-metal material, e.g. plastic, plasticity steel, or polymer. This way, the steps of individually manufacturing the prior art covering shell 613 and module covering shell 655 and then connecting together can be omitted to simplify the steps of the process and raise the production efficiency.

Further, an object of changing the appearance and reducing the manufacturing cost of the USB compatible application apparatus 60 can be achieved by choosing different materials of the USB covering shell 600. For example, when choosing plastic as the material of the USB covering shell 600, since the price of the plastic is cheaper than that of metal, the cost of the material can be reduced. Besides, the weight of plastic is lighter than that of metal, so the weight of the USB compatible application apparatus 60 can be reduced. Of course, when choosing the plastic to be a material of the USB covering shell 600, the edge of the connecting interface will not be as sharp as the prior art metal material. Therefore, the safety in use can be efficiently raised. Further, if changing the material of the USB covering shell 600, the appearance of the USB compatible application apparatus 60 will be quite different. Thereby, not only the variety of the USB compatible application apparatus 60 is increased, but also the entire appearance will be decorated to activate the consuming desire.

In summary, the present invention relates to an improved structure of USB compatible application apparatus, and more particularly to an improved structure of USB compatible application apparatus using a PCB circuit board to be a USB compatible application module of a connector. It can not only reduce a length of the USB compatible application apparatus but also efficiently raise working efficiency of the USB compatible application apparatus. Therefore, the present invention meets the requirements of the patent law and should be granted a patent.

The foregoing description is merely one embodiment of present invention and not considered as restrictive. All equivalent variations and modifications in process, method, feature, and spirit in accordance with the appended claims may be made without in any way from the scope of the invention.

LIST OF REFERENCE SYMBOLS

10 USB application apparatus
11 USB connector
111 carrying board
113 covering shell
115 connecting sandwich
13 connecting terminator
131 VCC power source line
133 D+ data transmission line
135 D− data transmission line
137 GND power source line
15 USB application module
151 control circuit
153 memory element
155 covering shell
157 circuit board
17 protection cap
20 USB compatible application apparatus
200 USB compatible application apparatus
21 connector
211 PCB carrying board
213 covering shell
215 connecting sandwich
217 board bottom sandwich
218 supportive structure
219 front end protection layer
23 first connecting terminator
231 VCC power source line
233 first data transmission line
235 second data transmission line
237 GND power source line
24 electrical element
25 USB compatible application module
251 control circuit
253 memory device
255 module covering shell
257 application circuit board
27 protection plug
271 exposed end
273 plugging end
275 fix end
32 bottom data transmission line
320 bottom gap
321 fifth data transmission line
322 third data transmission line
323 fourth data transmission line
324 sixth data transmission line
325 seventh data transmission line
326 eighth data transmission line
327 ninth data transmission line
40 USB compatible application module
41 connector
411 PCB carrying board
413 covering shell
417 board bottom sandwich

43 first connecting terminator
431 VCC power source line
432 bottom data transmission line
433 first data transmission line
435 second data transmission line
437 GND power source line
45 USB compatible application module
49 board bottom data transmission line
50 USB compatible application apparatus
51 connector
513 covering shell
55 USB compatible application module
555 module covering shell
60 USB compatible application apparatus
600 USB covering shell
61 connector
613 covering shell
65 USB compatible application module
655 module covering shell
70 USB connecting bracket
71 second connecting terminator

The invention claimed is:

1. A structure of a USB compatible application apparatus, comprising a connector being capable of connecting to a USB compatible application module, wherein said connector has a covering shell to cover a PCB carrying board made of a PCB circuit board, and a top surface of said PCB carrying board forming a connecting sandwich with said covering shell, said top surface of said PCB carrying board comprising a plurality of first connecting terminators capable of electrically connecting to said USB compatible application module, said connecting sandwich plugging with a corresponding USB connecting bracket, said first connecting terminators electrically connected to a plurality of second connecting terminators fixed in said USB connecting bracket when said USB connecting bracket is plugged into said connecting sandwich, a board bottom sandwich further is formed between a bottom surface of said PCB carrying board inside of said connector and said covering shell, wherein said board bottom sandwich has at least one supporting structure, front end protection layer, and a combination thereof capable of connecting to said PCB carrying board, and at least one electrical element being fixed on said bottom surface of said PCB carrying board.

2. The structure according to claim 1, wherein said covering shell of said connector is made of a non-metal material.

3. The structure according to claim 1, wherein said USB compatible application module is selected from the group a memory, flash drive, blue tooth, digital camera, MP3 walkman, control circuit, GPS, digital voice recorder, television module, wireless network card module, system host, and a combination thereof.

4. The structure according to claim 1, wherein said electrical application module has an application circuit board therein, and said circuit board is formed integrally with said PCB carrying board.

5. The structure according to claim 1, wherein said electrical element can selectively be one of a control circuit and a board bottom data transmission line.

6. The structure according to claim 1, wherein a top surface of said PCB carrying board further comprises another data transmission line.

7. The structure according to claim 1, wherein said connecting sandwich is capable of plugging with a corresponding protection plug, said protection plug having an exposed end, and said exposed end traversing and connecting to a plugging end, and said plugging end plugging into said connecting sandwich.

8. The structure according to claim 1, wherein a sectional area of said exposed end of said protection plug is larger than said sectional area of said connector.

9. The structure according to claim 1 further comprising a module covering shell capable of wrapping said USB compatible application module, and said module covering shell capable of being formed integrally with a module covering shell of said connector.

10. The structure according to claim 1, wherein said USB compatible application apparatus is a USB compatible connecting line.

* * * * *